United States Patent [19]

Iwanami et al.

[11] Patent Number: 4,502,524

[45] Date of Patent: Mar. 5, 1985

[54] PROCESS AND APPARATUS FOR THE PRODUCTION OF A METALLIC LAMINAR COMPOSITE MATERIAL

[75] Inventors: Yoshiyuki Iwanami; Kozo Taniguchi; Mitsunori Funazaki; Tomoo Takenouchi, all of Hokkaido, Japan

[73] Assignee: The Japan Steel Works, Ltd., Tokyo, Japan

[21] Appl. No.: 444,907

[22] Filed: Nov. 29, 1982

[30] Foreign Application Priority Data

May 28, 1982 [JP] Japan ..... 57-89764

[51] Int. Cl.[3] ..... B22D 21/02; B22D 19/00; B22D 23/00

[52] U.S. Cl. ..... 164/66.1; 164/100; 164/137

[58] Field of Search ..... 164/98, 99–100, 164/119, 306, 66.1, 137, 339

[56] References Cited

U.S. PATENT DOCUMENTS 980,719 1/1911 Westlake ..... 164/98
3,371,703 3/1968 DeWilde ..... 164/98
3,604,497 9/1971 Sylvester ..... 164/137

FOREIGN PATENT DOCUMENTS 55-136555 10/1980 Japan ..... 164/119
57-28662 2/1982 Japan ..... 164/306

*Primary Examiner*—Kuang Y. Lin
*Assistant Examiner*—Richard K. Seidel
*Attorney, Agent, or Firm*—Sughrue, Mion, Zinn, Macpeak, and Seas

[57] ABSTRACT

A process and apparatus for producing a metallic laminar composite material utilizes a pressure tank, a ladle, and a dip tube for transferring molten metal into a mold which has a metallic plate suspended within it. The molten metal is supplied by the ladle and the dip tube in such a way that slag and scum existing on the surface of the molten metal are not introduced into the mold. Prior to introducing the molten metal into the mold, the mold is purged with an inert gas to prevent oxidation of the surface of the metallic plate. The mold is made of freely movable carbon segments which permit easy assembly and disassembly of the mold for varying the size of the molding chamber.

1 Claim, 5 Drawing Figures

PROCESS AND APPARATUS FOR THE PRODUCTION OF A METALLIC LAMINAR COMPOSITE MATERIAL

BACKGROUND OF THE INVENTION

1. Field of the Invention

The present invention relates to a process and apparatus for producing metallic composite materials.

2. Description of the Prior Art

Conventional two- or three-layer metallic composite plates can be produced by preparing different metallic plates separately, cutting the plates to predetermined dimensions, combining the plates together, and pressure-bonding the plates by rolling or bonding them by an explosion technique. In accordance with this method, since different metallic plates are required to be produced separately and cut to predetermined dimensions prior to being bonded together, this method results in relatively low yield. In addition, the production steps are complicated, and the production costs are high.

In order to overcome the above-described problems, another method has been proposed and is now in practical use. In this method, a metallic plate is placed in a mold at a predetermined position, and a second metal in molten form is then poured into the mold in such a manner that the second metal surrounds the metallic plate to produce a metallic laminar composite material. Of course, the second molten metal has a different composition than the metal of the metallic plate.

FIG. 5 illustrates a prior art apparatus for making a metallic laminar composite material according to this latter method. In FIG. 5, a metallic plate 1 is covered with a surface coating agent to prevent oxidation of the surface of the metallic plate 1, and this plate is hung in a mold 13 which is made of cast iron. The mold 13 is covered at a predetermined position with a heat-insulating plate 12 which has a riser portion. A second, different molten metal is then introduced through an injection pipe 14 and a runner brick 15 and is charged into a clearance between the mold 13 and the metallic plate 1 to form a metallic laminar composite material. This method, however, suffers from the following disadvantages:

First, in order to eliminate various factors which inhibit efficient bonding between the metallic plate 1 and the second molten metal in a subsequent bonding processing step (for example, pressure-bonding by rolling), it is necessary to coat the surface of the metallic plate uniformly with a coating agent. The coating agent is required to prevent the surface of the metallic plate 1 from oxidizing when the second molten metal is poured into the mold 13, and it is also required to minimize the adverse effects caused by the introduction of scum which enters the mold as the molten metal is poured into the mold. Furthermore, not all coating agents will satisfactorily prevent oxidation from occurring or minimize the effects of scum, and the conditions under which the second molten metal is poured are required to be strictly controlled.

Second, to change the ratio in thickness of the metallic plate 1 and the second metal plate resulting from the different molten metal in the finished metallic laminar composite material, it is necessary to change either the thickness of the plate 1 or the thickness of the cast second plate. Therefore, depending on the dimensions of the articles to be produced, it is often necessary to employ different metal molds which have different dimensions.

Third, since the mold is made of cast iron, surface cracking of the second metal after it has been solidified is likely to occur, depending on casting conditions.

Fourth, in order to compensate for shrinkage as the second molten metal cools and solidifies, it is necessary to provide a riser over the entire mold head, and this leads to a reduction in yield.

Fifth, due to repeated castings, the surface of the mold tends to wear out over time, and the thickness of the second metal in the finished metallic laminar composite material becomes uneven. Accordingly, dimensional accuracy is reduced.

SUMMARY OF THE INVENTION

The process and apparatus of the present invention, although based on the same principle as the cast enveloping method of FIG. 5, is completely free from the above-described defects of the conventional cast enveloping method and apparatus. In addition, the process and apparatus of the present invention allows one to produce two- or three-layer metallic composite materials effectively and inexpensively. Thus, the invention has the effect of broadening the industrial applicability of the cast enveloping method and apparatus shown in FIG. 5.

The present invention relates to a process for producing a metallic laminar composite material which comprises the steps of: (1) placing a first metallic plate in a pressure-casting mold at a predetermined position; (2) sealing the mold; (3) purging the interior of the mold with inert gas; (4) applying pressure onto a pressure tank adapted to accommodate a ladle which is placed below the mold, thereby sending a second metal in molten form into the ladle through a dip tube which is inserted into the ladle from the mold; and (5) casting the molten metal, under pressure, around the inserting material to produce the desired metallic laminar composite material. In addition, the present invention relates to an apparatus for practicing the process described above.

DESCRIPTION OF THE PREFERRED EMBODIMENTS

Figure 1:
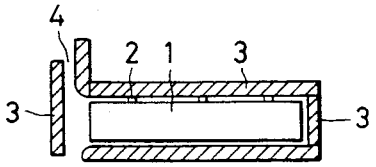
FIGS. 1 and 2 are a front view and a side view, respectively, of a mold for use in casting a metallic laminar composite material according to the process of the present invention.
Figure 2:
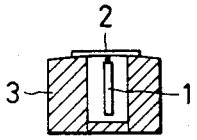
Figure 3:
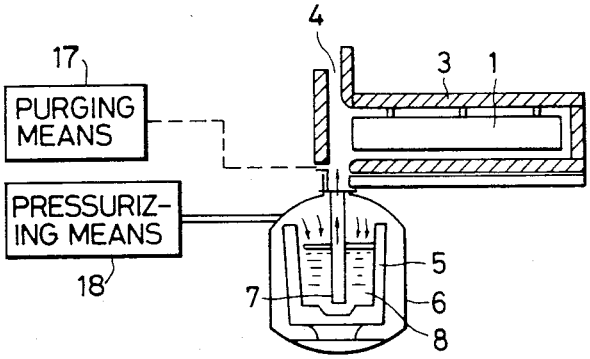
FIG. 3 is a total schematic view of the mold of FIGS. 1 and 2.

FIG. 3 shows an apparatus for use in the practice of the process of the present invention. As illustrated in FIGS. 1 and 2, a first metallic plate 1 is set by means of hangers 2 at a predetermined position in a pressure-casting mold 3 which is made of graphite segments. The inner surface of the mold 3 is uniformly coated with an alumina-based coating agent. The position of the first metallic plate 1 inside the mold can be changed appropriately when it is desired to change the thickness of the finished metallic laminar composite material.

Figure 4:
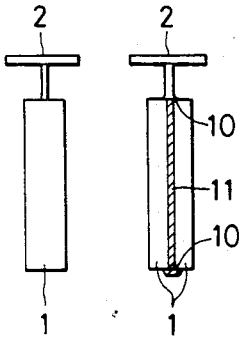
FIG. 4 shows inserting materials for the production of two- and three-layer composite materials.
Figure 5:
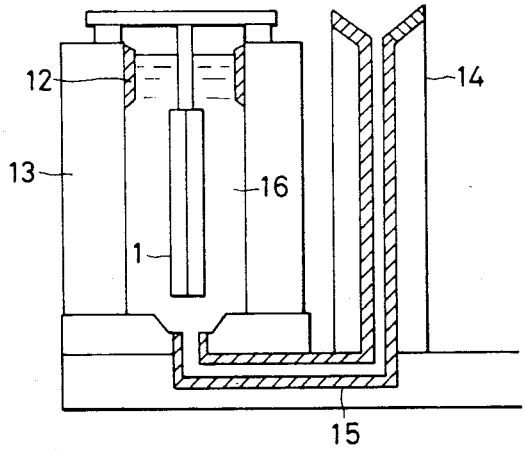
FIG. 5 PRIOR ART
FIG. 5 is a schematic, cross-sectional view of a mold for use in casting a metallic laminar composite material according to the conventional cast enveloping method.

To produce a three-layer composite material, one metallic plate 1 is set in the mold, as shown in the left-hand portion of FIG. 4. In order to produce a two-layer composite material, two metallic plates 1—1 are bonded together and welded at their circumference at a welding portion 10, as shown in the right-hand portion of FIG. 4. The thus-welded member is then used as an inserting material and is set in the mold. In bonding the two metallic plates 1—1 together, an interface between the two plates is coated with a separating agent 11 so that the resulting composite material can be easily separated into two, two-layer composite materials by cutting out the welded portion after pressure-bonding by rolling at a later stage.

After the metallic plate or plates 1 have been set in the mold 3, the mold is sealed, except for a small riser 4 which is located above the mold 3, and the interior of the mold 3 is purged with an inert gas, such as argon gas, by purging means 17. Thereafter, a second metal 8, in molten form, is rapidly charged into a clearance between the metallic plate 1 and the interior walls of the mold, and the metals 1, 8 are cast under pressure. To charge the mold 3, a ladle 5, which contains a dip tube 7 and the second molten metal 8, is placed in a pressure tank 6, and pressure is applied into the tank by pressurizing means 18 so that the molten metal 8 is rapidly poured into the mold 3.

In accordance with the process and apparatus of the invention as described, the oxidation of the surface of the metallic plate 1 is completely prevented because casting is performed in an inert gas atmosphere. Furthermore, because the molten metal 8 is sent through the dip tube 7 and cast under pressure, it is possible to charge the molten metal gently and rapidly into the clearance between the metallic plate 1 and the mold 3 without allowing slag and scum, located on the surface of the molten metal contained in the ladle 5, to enter the mold 3. In other words, since the molten metal 8 which is transferred into the mold 3 is not obtained from the surface of the molten metal 8, slag and scum resting on the surface of the molten metal is not transmitted to the mold 3 with the molten metal 8. Therefore, substances, such as oxides and scum which inhibit the bonding of the metallic plate 3 and the different molten metal 8, are completely prevented from coming in contact with an interface between the molten metal and the metallic plate.

Since the mold utilized for pressure casting in the practice of the process of the present invention can be assembled and dismantled with ease because of the movable graphite mold segments 3 as shown in FIGS. 1, 2 and 3, the horizontal and vertical size of the inside of the mold can be changed appropriately when it is desired to change the thickness of the ultimate composite material—thus, there is great freedom in altering the plate thickness. Therefore, by simply changing the thickness of the metallic plate 1 material, the thickness of each of the metal plates and the ratio of the first plate to the second plate can be changed easily.

The thus-obtained metallic composite material is then rolled to a predetermined thickness. In the case of the three-layer composite material, the welded portion at the circumference of the composite material is eliminated. On the other hand, in the case of the two-layer composite material, the welded portion at the circumference of the composite material is removed and the material is separated into two, two-layer metallic composite materials.

Some of the major advantages of the process and apparatus of the present invention over the conventional cast enveloping method and apparatus are as follows:

(1) It is not necessary to use a coating agent, which is employed in the conventional method, for the purpose of removing factors inhibiting the bonding of the metallic plate 1 and the different molten metal during the subsequent pressure-bonding by rolling step. Such factors include oxidation of the surface of the metallic plate (i.e. the metallic plate 1 is free of any such oxidation-preventing coating) and the introduction of scum into the interface between the metallic plate and the different molten metal plate. Scum is introduced into the mold in the conventional method because the molten metal is simply poured into the mold 13.

(2) Because the mold for pressure casting, according to the apparatus and method of the present invention, can be assembled and dismantled with ease because of the movable graphite mold segments, the size of the inside of the mold can be changed appropriately and optionally. Therefore, it is possible to produce metallic laminar composite materials easily which have varied plate thicknesses and ratios in thickness of the different metallic plates.

(3) Because the mold for use in the conventional cast enveloping method is made of cast iron, surface defects may be formed in the peripheral metal part of the composite material, depending on casting conditions. However, in the process of the present invention in which a graphite mold and an alumina-based coating material are used, the surface conditions of the outer peripheral part of the composite material are greatly improved.

(4) In the conventional cast enveloping method, a riser 12, which is positioned over the entire head of the mold 13, is required to accommodate shrinkage of the molten metal 16 which occurs as this metal solidifies. On the other hand, in the process of the present invention, a major portion at the head side is sealed, and it is sufficient to provide a small riser 4 over a limited area. Thus, the process of the present invention results in an increased yield.

(5) Because the mold used for pressure casting in the practice of the process of the present invention can be assembled and dismantled with ease, when the inner surface of the mold is worn out, it is sufficient to apply an abrasive surface treatment on the surface; therefore, surface dimensional accuracy can easily be maintained. Thus, the dimensional accuracy of the metallic laminar composite material is increased.

We claim:

1. A process for producing a metallic laminar composite material, comprising the steps of:

placing a metallic plate (1) in a pressure-casting mold (3) having a small riser (4) and having an alumina-based coating on its interior surface, and said plate being free of any oxidation-preventing coating;

purging the interior of said mold with an inert gas; and applying pressure to a pressure tank (6) having a ladle (5) containing a molten metal (8), said ladle having a dip tube (7) for transferring said molten metal to said interior of said mold, whereby the molten metal is cast under pressure around the metallic plate to produce a metallic laminar composite material; wherein said molten metal is different in composition than said metal plate; and wherein said mold is constructed of movable graphite segments;

and comprising the further step of varying the size of said interior of said mold between castings by adjusting the relative positions of said segments; and further comprising coating the interface of separate metallic plates and bonding said separate metallic plates together to form said metallic plate which is placed in said mold.

* * * * *